US012037160B2

(12) United States Patent
Sako et al.

(10) Patent No.: US 12,037,160 B2
(45) Date of Patent: Jul. 16, 2024

(54) PACKAGING CONTAINER, PACKAGING METHOD, AND METAL FOIL TRANSPORT METHOD

(71) Applicant: JX Nippon Mining & Metals Corporation, Tokyo (JP)

(72) Inventors: Akira Sako, Aichi (JP); Yasunobu Miyata, Ska-shi-Saitama (JP); Kazuhiko Kikuchi, Ibaraki (JP)

(73) Assignee: JX Advanced Metals Corporation, Tokyo (JP)

( * ) Notice: Subject to any disclaimer, the term of this patent is extended or adjusted under 35 U.S.C. 154(b) by 77 days.

(21) Appl. No.: 17/795,955

(22) PCT Filed: Jan. 22, 2021

(86) PCT No.: PCT/JP2021/002330
§ 371 (c)(1),
(2) Date: Jul. 28, 2022

(87) PCT Pub. No.: WO2021/153463
PCT Pub. Date: Aug. 5, 2021

(65) Prior Publication Data

US 2023/0073092 A1 Mar. 9, 2023

(30) Foreign Application Priority Data

Jan. 31, 2020 (JP) ..... 2020015490

(51) Int. Cl.
*B65D 19/00* (2006.01)
*B65D 5/44* (2006.01)
(Continued)

(52) U.S. Cl.
CPC ..... *B65D 19/0024* (2013.01); *B65D 5/445* (2013.01); *B65D 5/5021* (2013.01);
(Continued)

(58) Field of Classification Search
CPC ..... B65D 19/44
(Continued)

(56) References Cited

U.S. PATENT DOCUMENTS 2,534,011 A 12/1950 Moine
3,568,912 A * 3/1971 de Simas ..... B65D 19/20 206/811

(Continued)

FOREIGN PATENT DOCUMENTS

CN 101289134 A 10/2008
CN 206954788 U 2/2018

(Continued)

OTHER PUBLICATIONS

International Preliminary Report on Patentability of Corresponding PCT application No. PCT/JP2021/002330, dated Aug. 11, 2022, 6 pages.

(Continued)

*Primary Examiner* — Jose V Chen
(74) *Attorney, Agent, or Firm* — Faegre Drinker Biddle & Reath LLP

(57) ABSTRACT

Provided are a packaging container, a packaging method, and a method for carrying metal foil, which can suppress damage and deformation of the packaging container and enable stable carrying even if the packaging container is carried while suspending it in the midair. A packaging container made of corrugated cardboard includes: a pallet 2 having leg portions 21; a body frame 3 arranged on the pallet 2, the body frame 3 having bearing grooves 31 at end wall portions 32 opposing to each other; and a lid portion 4 provided on the body frame 3, wherein each of the leg portions 21 is arranged on an inner side than each of the end wall portions 23 of the pallet 2.

18 Claims, 14 Drawing Sheets

(51) Int. Cl.

| | |
|---|---|
| ***B65D 5/50*** | (2006.01) |
| ***B65D 5/68*** | (2006.01) |
| ***B65D 19/20*** | (2006.01) |
| ***B65D 19/36*** | (2006.01) |
| ***B65D 19/44*** | (2006.01) |
| ***B65D 85/66*** | (2006.01) |
| ***B65D 85/672*** | (2006.01) |

(52) U.S. Cl.
CPC ..... *B65D 5/68* (2013.01); *B65D 19/20* (2013.01); *B65D 19/36* (2013.01); *B65D 19/44* (2013.01); *B65D 85/66* (2013.01); *B65D 85/672* (2013.01); *B65D 2519/00019* (2013.01); *B65D 2519/00054* (2013.01); *B65D 2519/00124* (2013.01); *B65D 2519/00159* (2013.01); *B65D 2519/00194* (2013.01); *B65D 2519/00273* (2013.01); *B65D 2519/00288* (2013.01); *B65D 2519/00293* (2013.01); *B65D 2519/00323* (2013.01); *B65D 2519/00333* (2013.01); *B65D 2519/00437* (2013.01); *B65D 2519/00452* (2013.01); *B65D 2519/00502* (2013.01); *B65D 2519/00562* (2013.01); *B65D 2519/00582* (2013.01); *B65D 2519/00621* (2013.01); *B65D 2519/00641* (2013.01); *B65D 2519/00711* (2013.01); *B65D 2519/0082* (2013.01); *B65D 2519/0094* (2013.01)

(58) Field of Classification Search
USPC ..... 108/51.3, 55.1, 55.3, 55.5
See application file for complete search history.

(56) References Cited

U.S. PATENT DOCUMENTS

| | | | | | |
|---|---|---|---|---|---|
| 3,904,105 | A * | 9/1975 | Booth | B65D 5/12 | 206/386 |
| 4,697,699 | A * | 10/1987 | Schneider | B65D 19/20 | 206/599 |
| 5,230,291 | A * | 7/1993 | Juvik-Woods | B65D 19/0012 | 428/116 |
| 5,411,786 | A * | 5/1995 | Kuo | B65D 19/0012 | 428/184 |
| 5,588,372 | A * | 12/1996 | Kelly | B65D 19/385 | 108/55.1 |
| 5,704,487 | A * | 1/1998 | Taravella | B65D 19/20 | 206/599 |
| 5,794,542 | A * | 8/1998 | Besaw | B65D 19/20 | 108/56.1 |
| 5,918,744 | A * | 7/1999 | Bringard | B65D 19/20 | 206/596 |
| 5,931,435 | A * | 8/1999 | Hoadley | B65D 19/44 | 108/55.3 |
| 6,019,226 | A * | 2/2000 | Zajdlik | B65D 19/16 | 206/600 |
| 6,041,718 | A * | 3/2000 | Brandes | B65D 19/0012 | 108/55.1 |
| 6,052,912 | A * | 4/2000 | May | E04F 21/26 | 33/645 |
| 6,070,726 | A * | 6/2000 | Graham | B65D 19/0012 | 206/386 |
| 6,832,562 | B2 * | 12/2004 | Tabor | B65D 19/0028 | 108/55.1 |
| 7,080,864 | B2 * | 7/2006 | Casteran | B66C 1/16 | 294/67.4 |
| 7,322,480 | B2 * | 1/2008 | Bragadeste | B65D 19/20 | 53/458 |
| 7,681,735 | B2 * | 3/2010 | Youell, Jr. | B65D 19/20 | 206/599 |
| 8,011,307 | B2 * | 9/2011 | Marcelli | F16C 29/046 | 108/55.3 |
| 8,221,869 | B2 * | 7/2012 | Pare | B65D 81/02 | 428/126 |
| 8,316,779 | B2 * | 11/2012 | Gordon | B65D 19/20 | 108/51.11 |
| 8,783,461 | B2 * | 7/2014 | Hill | B65D 19/20 | 206/600 |
| 8,783,547 | B2 * | 7/2014 | Tabor | B65D 5/32 | 108/51.3 |
| 2002/0189507 | A1 * | 12/2002 | Benner | B65D 19/0028 | 108/56.3 |
| 2003/0052038 | A1 * | 3/2003 | Boersma | B65D 19/20 | 229/101 |
| 2003/0079657 | A1 * | 5/2003 | Preisler | B65D 19/0012 | 108/51.3 |
| 2005/0229819 | A1 * | 10/2005 | Hollander | B65D 19/0026 | 108/51.3 |
| 2007/0215014 | A1 | 9/2007 | Lee | | |
| 2007/0227936 | A1 * | 10/2007 | Youell | B65D 19/20 | 206/600 |
| 2008/0000396 | A1 * | 1/2008 | Tabor | B65D 19/44 | 108/55.1 |
| 2008/0116345 | A1 * | 5/2008 | O'Malley | B65D 71/70 | 248/346.01 |
| 2008/0196633 | A1 * | 8/2008 | Ho | B65D 71/70 | 108/51.3 |
| 2009/0053033 | A1 * | 2/2009 | Barbalho | B65D 19/0095 | 108/51.11 |
| 2012/0031791 | A1 * | 2/2012 | Katsurayama | B65D 85/66 | 206/397 |
| 2014/0090998 | A1 * | 4/2014 | Kimoto | B65D 5/50 | 206/391 |
| 2014/0124464 | A1 * | 5/2014 | Nijakowski | B65D 19/44 | 211/60.1 |
| 2023/0028632 | A1 * | 1/2023 | Samaras | B65H 16/021 | |

FOREIGN PATENT DOCUMENTS

| | | | | | |
|---|---|---|---|---|---|
| CN | 107954049 | A | | 4/2018 | |
| CN | 110436016 | A | | 11/2019 | |
| CN | 113286750 | A | * | 8/2021 | B65D 25/02 |
| DE | 29723338 | U1 | | 8/1998 | |
| DE | 102015001177 | A1 | * | 9/2015 | B65D 25/10 |
| JP | 297236 | U | | 8/1990 | |
| JP | 630035 | U | | 4/1994 | |
| JP | 676052 | U | | 10/1994 | |
| JP | 09315430 | A | | 12/1997 | |
| JP | 2000142669 | A | | 5/2000 | |
| JP | 2001080631 | A | | 3/2001 | |
| JP | 2002080087 | A | | 3/2002 | |
| JP | 2002205736 | A | | 7/2002 | |
| JP | 2002284281 | A | | 10/2002 | |
| JP | 2003072754 | A | | 3/2003 | |
| JP | 2004155442 | A | | 6/2004 | |
| JP | 2006131246 | A | | 5/2006 | |
| JP | 2006306498 | A | | 11/2006 | |
| JP | 2007062837 | A | | 3/2007 | |
| JP | 2008056288 | A | | 3/2008 | |
| JP | 2012131558 | A | | 7/2012 | |
| JP | 2014058398 | A | * | 4/2014 | B65D 19/02 |
| JP | 2018030591 | A | | 3/2018 | |
| JP | 2019156478 | A | | 9/2019 | |
| TW | M296205 | U | | 8/2006 | |
| TW | 201900510 | A | | 1/2019 | |
| WO | 2005030611 | A1 | | 4/2005 | |
| WO | WO-2005030611 | A1 | * | 4/2005 | B65D 85/66 |
| WO | 2019220997 | A1 | | 11/2019 | |

OTHER PUBLICATIONS

International Search Report for PCT/JP2021/002330 dated Mar. 23, 2021, 4 pages.

JP Office Action for Japanese patent application No. 2020-015490 dated Jun. 6, 2023, 13 pages.

Japan Office Action for corresponding JP Patent Application No. 2020-015490 mailed on Oct. 24, 2023, 16 pages (with English translation).

(56) References Cited

OTHER PUBLICATIONS

Extended European Search Report for corresponding EP 21747926.0 application, dated Mar. 28, 2023, 8 pages.

* cited by examiner

PACKAGING CONTAINER, PACKAGING METHOD, AND METAL FOIL TRANSPORT METHOD

FIELD OF THE INVENTION

The present invention relates to a packaging container, a packaging method, and a method for carrying metal foil.

BACKGROUND OF THE INVENTION

Various packaging containers for carrying roll materials has been known. For example, Japanese Patent Application Publication No. 2018-30591 A (Patent Literature 1) discloses an example of a card board container made of corrugated cardboard which includes a square pallet and a body frame placed on the pallet, and configured to house a roll material in a cylindrical body by supporting support shafts provided at both ends of the roll material by shaft bearing grooves formed in a body flame.

CITATION LIST

Patent Literature

[Patent Literature 1] Japanese Patent Application Publication No. 2018-30591 A

SUMMARY OF THE INVENTION

Technical Problem

When carrying the corrugated cardboard container as described in Patent Literature 1, the container is leaded while inserting forklift jaws of a forklift between girders at the bottom of the container. However, if the inserted position of the forklift jaws is improper, the forklift jaws may break through the container, causing damage to the container.

Another possible carrying method is to use a crane or other carrying apparatus to lift up the corrugated cardboard container via a rope or the like and carry the container while suspending it in the midair. However, depending on the shape and weight of the container, it may be deformed or may be inclined when it is carried, resulting in difficulty in stable carrying.

In light of the above problems, the present disclosure provides a packaging container, a packaging method, and a method for carrying metal foil, which can suppress damage and deformation of the packaging container and enable stable carrying even if the packaging container is carried while suspending it in the midair.

Solution to Problem

To solve the above problems, in an aspect, an embodiment according to the present invention encompasses a pallet including leg portions; a body frame arranged on the pallet and including bearing grooves provided at end wall portions opposing to each other; and a lid portion provided on the body frame, wherein the leg portions are arranged on an inner side than end wall portions of the pallet.

In another aspect, an embodiment according to the present invention encompasses a packaging method, the method including housing an object to be contained in the above packaging container, and binding a top surface of the lid portion of the packaging container containing the object and a bottom surface of the pallet together, using a binding member.

In yet another aspect of the present invention, an embodiment according to the present invention encompasses a method for carrying metal foil, the method including: housing in the above packaging container an object to be contained, the object being formed by winding a material comprised of metallic foil around its shaft center; binding a top surface of the lid portion of the packaging container containing the object and a bottom surface of the pallet together, using a binding member; bringing a lifting member for lifting and carrying into contact with a holding surface provided on a bottom surface between each of end wall portions and each of leg portions of the pallet of the packaging container containing the object; and carrying the packaging container while lifting up the packaging container.

Advantageous Effects of Invention

According to the present disclosure, it is possible to provide a packaging container, a packaging method, and a method for carrying metal foil, which can suppress damage and deformation of the packaging container and enable stable carrying even if the packaging container is carried while suspending it in the midair.

DETAILED DESCRIPTION OF THE INVENTION

Hereinafter, embodiments of the present invention will be described with reference to the drawings. It should be noted that embodiments shown below illustrate devices and methods for embodying the technical idea of the present invention, and the technical idea of the present invention is not intended to limit structures, arrangements, etc. of components to those described below. A plurality of components disclosed in the embodiments of the present invention may form various inventions by appropriate combinations. For example, some components may be removed from all the components shown in the embodiment, or components of different embodiments may be combined as appropriate.

(Packaging Container)

Figure 1:
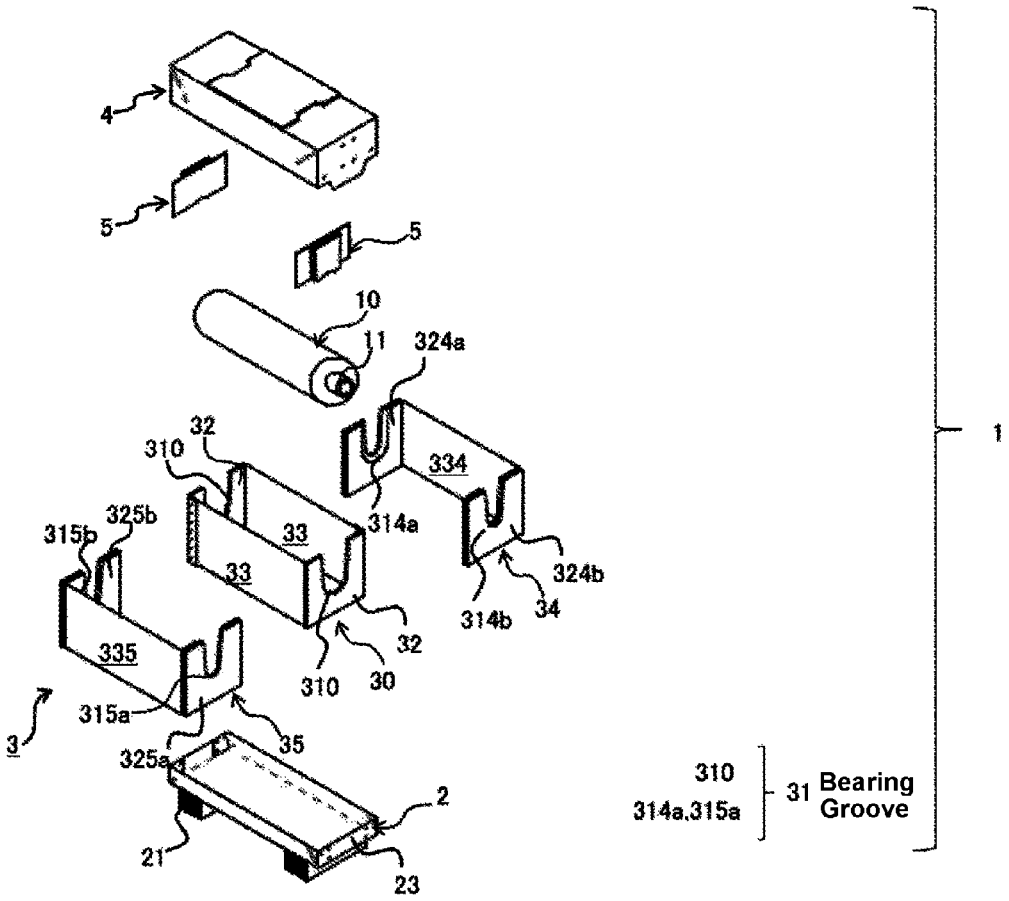
FIG. 1 is an exploded perspective view showing an example of a packaging container according to an embodiment of the present invention.

As shown in FIG. 1, a packaging container 1 according to the present invention includes: a pallet 2 having leg portions 21; a body frame 3 arranged on the pallet 2 and having bearing grooves 31 in end wall portions 32 opposing to each other; and a lid 4 portion provided above the body frame 3. The packaging container 1 may further include, in the bearing grooves 31, upper holding members 5 which prevents movement of shaft support portions 11 which are supported by the bearing grooves 31. Each member of the packaging container 1 may be made of wood, plastic, or the like, and more preferably corrugated cardboard.

An object 10 to be contained in the packaging container 1 is not particularly limited as long as it is a roll material formed by winding various films, sheets, foils, strips or other materials such as metals, plastics, paper and synthetic resins around a shaft center 12. In particular, this embodiment describes the use of a copper foil roll, in which copper foil or copper alloy foil is wound around the shaft center 12, as the object 10 to be contained, although not limited to thereto.

Figure 2:
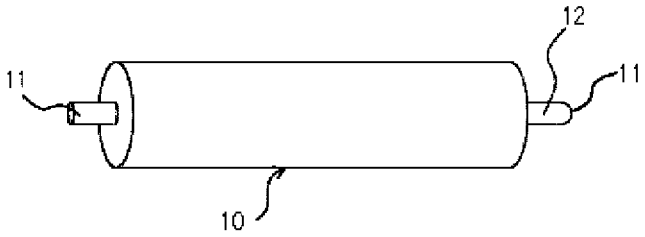
FIG. 2 is an external perspective view showing a structure of a roll material.

As shown in FIG. 2, the object 10 to be contained has the shaft support portions 11 protruding from each of both end portions in the axial direction of the shaft center 12. The object 10 to be contained can be housed in the body frame 3 while being suspended in the midair, by supporting the shaft support portions 11 of the object 10 with the bearing grooves 31 of the body frame 3. This can reduce an impact of external force and gravity applied to the roll portion of the object 10, thereby suppressing deformation of the object 10.

Figure 3:
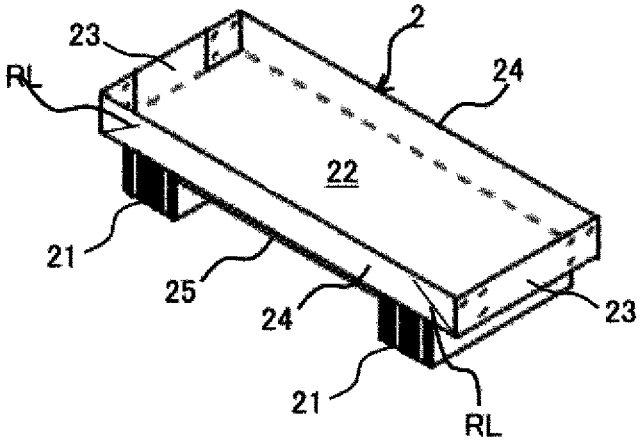
FIG. 3 is an external perspective view showing a structure of a pallet.

As shown in FIG. 3, the pallet 2 includes: a bottom surface 22 on which the body frame 3 is placed; a pair of end wall portions 23 opposing to each other, each of the end wall portion 23 rising from the bottom surface 22; and a pair of side wall portions 24 that are continuous to the end wall portions 23, rise from the bottom surface 22 and oppose to each other; and leg portions 21 connected to the bottom surface 22. The end wall portions 23 and the side wall portions 24 are placed on the pallet 2, thereby allowing the body frame 3 loaded on the pallet 2 to be housed in a predetermined position to prevent misalignment of the body frame 3.

Figure 4:
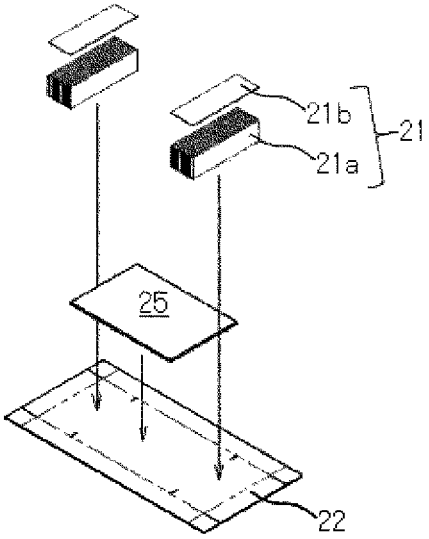
FIG. 4 is an exploded perspective view of a pallet.

As shown in FIG. 4, each of the leg portions 21 includes: a laminate portion 21*a* in which a plurality of corrugated boards each having a waved core bonded between liners are stacked and bonded together; a sheet-shaped leg reinforcing portion 21*b* bonded on the laminate portion 21*a*. Typically, the laminate portion 21*a* has a structure in which 5 to 20 corrugated boards each having a thickness of about 5 to 10 mm are laminated in a horizontal direction (perpendicular to a vertical direction) to the bottom surface 22 via adhesive layers. The leg reinforcing portion 21*b* is bonded so as to cover the end face of the laminate portion 21*a*, thereby reinforcing the bottom surface of each leg portion 21.

By placing the leg reinforcing portion 21*b* on the laminate portion 21*a*, the hardness of the bottom surface can be increased, thereby preventing any defect due to deformation during carrying such as damages and dents caused in the leg portions 21 during carrying. The load weight that can be loaded by the pallet 2 and the strength of the leg portions 21 can be controlled by selecting materials of the liners and the core of the corrugated board that would make up the laminate portion 21*a*, or by controlling the number of laminated corrugated boards.

Figure 5:
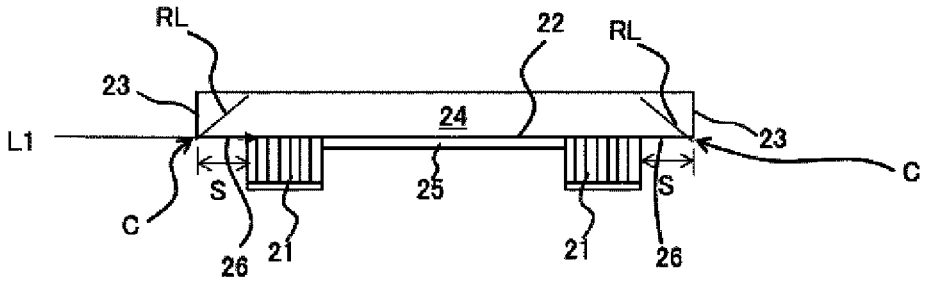
FIG. 5 is a front view showing leg portions and a holding portion of a pallet.
Figure 6:
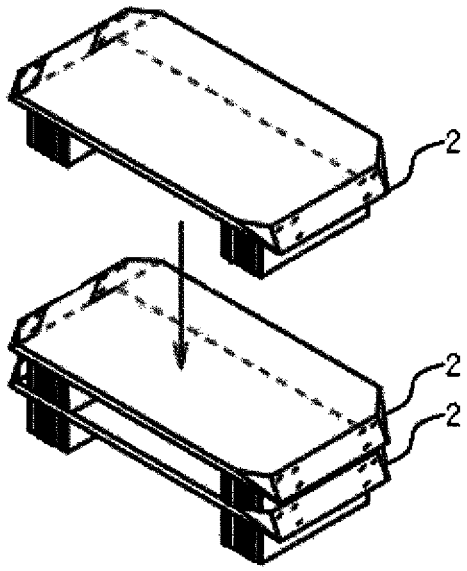
FIG. 6 is a perspective view showing a stacked state of pallets during storage.

As shown in FIG. 5, each of the leg portions 21 is arranged on an inner side (a center side) than each of the end wall portions 23 of the pallet 2, and at a certain space S from each of the end wall portions 23. The spaces S serve as holding surfaces 26 for hooking and holding a lifting tool at both ends of the packaging container 1. According to the packaging container 1 of this embodiment, the packaging container 1 can be more smoothly carried, because the lifting member such as a rope can be brought into contact with the holding surfaces 26, and the packaging container 1 can be lifted up and stably carried.

Further, the method of carrying the packaging container 1 while lifting it up can allow the packaging container 1 containing heavy items to be carried by crane or the like, even in a facility having a construction in which a forklift or the like cannot be accommodated. By thus increasing the options of the carrying method, the restriction on the facility for carrying the object 10 to be contained, which is the content of the packaging container 1, can be mitigated. It can also lead to improved safety at the work site.

Preferably, between the leg portions 21 of the bottom surface 22 of the pallet 2 is a bottom surface reinforcing portion 25 that can reinforce the bottom surface 22 of the pallet 2. This can reinforce the bottom surface 22 of the pallet 2 to suppress deformation of the packaging container 1 and improve its strength. Further, even if the binding force of a binding member 71 such as a band, as described below, is strong enough to dent into the bottom surface reinforcing portion 25 upon binding of the packaging container 1 with the binding member 71, any deformation of the pallet 2 itself can be suppressed. The binding member 71 is bound so that it is brough into contact with the bottom surface reinforcing portion 25 to allow the binding member 71 to dent into the bottom surface reinforcing portion 25, whereby the strength of the binding strength can also be improved.

As described above, when the lifting member such as a rope is brought into contact with the holding surfaces 26 to lift up the packaging container 1, the load is applied near the center of the packaging container 1, and as a result, the packaging container 1 may be deformed. To address this problem, the bottom surface reinforcing portion 25 can be provided to prevent the packaging container 1 from bending near the center when it is lifted up and carried. When the packaging container 1 is carried using a forklift or the like, any damage to the bottom surface 22 of the pallet 2 can be prevented even if the forklift jaws of the forklift are incorrectly operated.

The arrangement location, shape, and thickness of the bottom surface reinforcing portion 25 are not limited, and they may be selected in various ways depending on applications. The bottom reinforcing portion 25 can be further positioned on the holding surface 26 to further suppress the damage to the packaging container 1 during carrying.

The pallet 2 is provided with four folding lines RL each extending upward in a diagonal direction from each of four corners C of the rectangular bottom surface 22 of pallet 2 on each of the side wall portions 24. Each folding line RL is inclined at an inclination of about 45 degrees from a point (corner C) where the three planes of the bottom surface 22, the end wall portion 23 and the side wall portion 24 come into contact with one another, relative to a line L1 where the bottom surface 22 and the side wall portion 24 come into contact with each other. By folding the folding slines RL in a mountain fold manner, the pallets 2 can be stacked and stored while folding the end wall portions 23 and the side wall portions 24, so that storage spaces prior to assembly as the packaging container 1 can be reduced. When using the packaging container 1, it is sufficient to raise the end wall portions 23 and the side wall portions 24 of the pallet 2, so that it is easy to assemble the pallet 2.

As shown in FIG. 1, the body frame 3 includes a body frame main body 30, and at least one auxiliary frame 34, 35 stacked on the body frame main body 30. The body frame 3 composed of a plurality of members can improve the strength of the body frame body 30, including the bearing groove 31 provided by the body frame 3. The auxiliary frame 34, 35 may be omitted.

The body frame main body 30 has a pair of end wall portions 32 opposing to each other and a pair of side wall portions 33 opposing to each other, and the side wall portions 33 are provided between the end wall portions opposing to each other. The body frame main body 30 has first bearing grooves 310 for supporting the shaft support portions 11 of the object 10 in the end wall portions 32.

Figure 7:
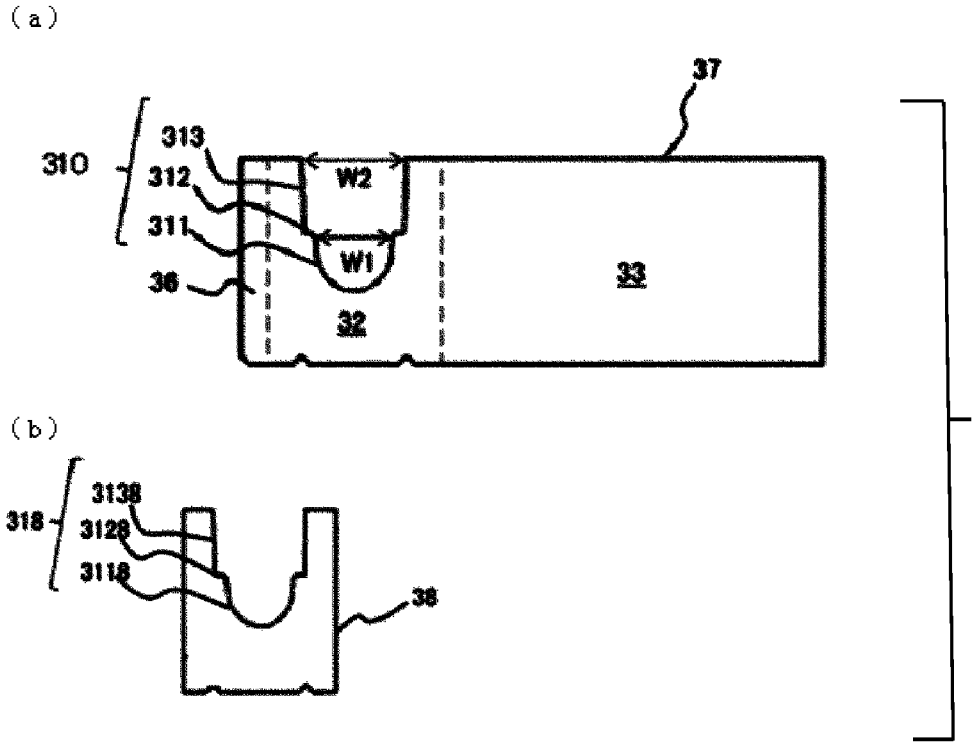
FIG. 7 shows: (a) a developed view of a body frame main body member forming a body frame main body, and (b) a developed view of a reinforcing pad stacked on a body frame main body.

The body frame main body 30 is formed into a cylindrical body as shown in FIG. 1 by joining two body frame main body members 37 as shown in FIG. 7(*a*). Each body frame main body member 37 includes: an end wall portion 32; a side wall portion 33 continuous to the end wall portion 32; and a joint flap portion 36 formed at the end of the end wall portion 32. The joint flap portion 36 of one body frame member 37 is connected to the end portion of the side wall portion 33 of the other body frame member 37, thereby providing the body frame main body 30.

The first bearing groove 310 has a housing portion 311 that can house the shaft support portion 11 at the lower end portion, and has a housing portion 313 that can house an upper holding member 55 at the upper end portion. The side surface of the first bearing groove 310 is provided with a locking portion 312 protruding toward an inner central direction of the first bearing groove 310, in order to come into contact with a lower end portion 54 (see FIG. 10) of the upper holding member 5 to support it. A bottom of a lower end portion 54 of the upper holding member 5 and an upper surface of the locking portion 312 are contacted with each other, whereby the first bearing groove 310 can be prevented from shifting downward.

The first bearing groove 310 has a size such that a width W1 in an arc horizontal direction of the lower end portion of the first bearing groove 310 has the same as or equivalent to a diameter of the shaft support portion 11 of the object 10. This allows the lower end portions of the first bearing grooves 310 to house the shaft support portions 11 protruding from both ends of the object 10. A width W2 in a horizontal direction of the upper end portion of the first bearing groove 310 is broader than the width W1 of the lower end portion of the first bearing groove 310. This can allow for easy housing of the shaft support portions 11 of the object 10 while preventing the damage to the end wall portions 32 of the body frame main body 30.

To the first bearing groove 310 of the body frame main body 30, one or more reinforcing pads 38 as shown in FIG. 7(*b*) may be affixed to the end wall portions 32 of the body frame main body member 37. This can improve a load bearing property of the first bearing groove 310.

The reinforcing pad 38 has a bearing groove 318 including: housing portions 3138, 3138 and a locking portion 3128 having substantially the same shape as the housing portions 311, 313 and the locking portion 312, respectively. Since the bearing groove 318 and the first bearing groove 310 have substantially the same shape, it is possible to prevent rattling when the shaft support portion 11 is placed. On the other hand, since the body frame main body 30 and the reinforcing pad 38 are made of corrugated cardboard, a certain dimensional allowance may be required, because the first bearing groove 310 and the bearing groove 318 may also be deformed due to the weight of the object 10 loaded on the bearing groove 318 and the first bearing groove 310 via the shaft support portions 11. Therefore, the first bearing groove 310 of the body frame main body 30 and the bearing groove 318 of the reinforcing pad 38 may not have exactly the same shape. The number of the reinforcing pads 38 stacked on the end wall portions 32 may be appropriately adjusted in view of the weight of the object 10 to be contained and the length of the shaft support portion 11 of the object 10.

Figure 8:
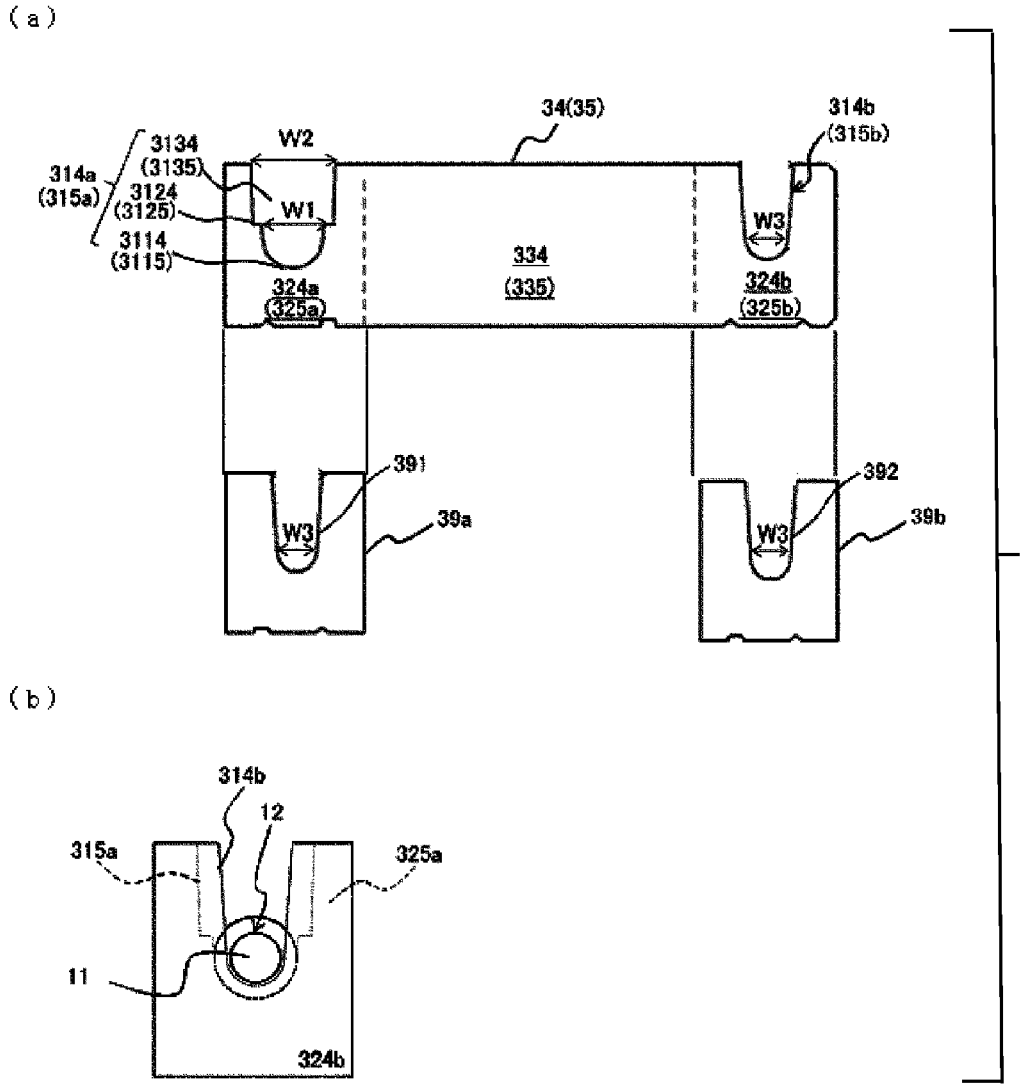
FIG. 8 shows: (a) a developed view of an auxiliary frame, and (b) a plane view showing a positional relationship among a first bearing groove, a second bearing groove and an object to be contained, in a case where the auxiliary frame is stacked on a body frame main body to form a body frame.

At least one auxiliary frame 34, 35 is stacked on the body frame main body 30. As shown in FIG. 8(*a*), the auxiliary frame 34 includes: an auxiliary side wall portion 334; and a first auxiliary end wall portion 324*a* and a second auxiliary end wall portion 324*b* arranged at both ends of the auxiliary side wall portion 334. The first auxiliary end wall portion 324*a* has a second bearing groove 314*a* provided with housing portions 3114, 3134 and a locking portion 3124 which have substantially the same shape as the first bearing groove 310. The second auxiliary end wall portion 324*b* includes a carrying arm insertion groove 314*b* in which a width W3 in an arc horizontal direction at the lower end portion is narrower than the width W1 in the arc horizontal direction at the lower end portion of the first bearing groove 310.

The auxiliary frame 35 may have the same structure as that of the auxiliary frame 34. That is, the auxiliary frame 35 includes: an auxiliary side wall portion 335; and a first auxiliary end wall portion 325*a* and a second auxiliary end wall portion 325*b* arranged at both ends of the auxiliary side wall portion 335. The first auxiliary end wall portion 325*a* includes a second bearing groove 315*a* having: housing portion 3115, 3135 and a locking portion 3125 which have substantially the same shape as the first bearing groove 310. The second auxiliary end wall portion 325*b* includes a carrying arm insertion groove 315*b* in which the width W3 in the arc horizontal direction at the lower end portion is narrower than the width W1 in the arc horizontal direction at the lower end portion of the first bearing groove 310.

The width W3 narrower than the width W1 means that the outside of the shaft support portion 11 comes into contact with the second auxiliary end wall portion 324*b*, and the second auxiliary end wall portion 324*b* cover a part of the shaft center 12 of the shaft support portion 11 (see FIG. 8(*b*)) when the body frame main body 30, the auxiliary frame 34, and the auxiliary frame 35 are stacked, and the shaft support portions 11 are placed on the end wall portions 32 and the first bearing groove 310 and/or the first auxiliary end wall portion 325*a* of the first auxiliary end wall portion 325*a*. This can allow the second auxiliary end wall portion 324*b* to restrict any axial movement of the object 10 contained in the packaging container 1. As a result, it is possible to reduce risks that the shaft support portions 11 will fall out of the bearing groove 31 during the carrying of the packaging container 1, and the object 10 will fall out and be damaged.

The width W3 of the carrying arm insertion groove 314*b* may be narrower than the width W1 to the extent that the axial movement of the object 10 can be restricted. Particularly, in an embodiment where the shaft center 12 of the shaft support portions 11 has a hollow structure, and the carrying arm of the carrying device for the object 10 is inserted into an inner side of the shaft center 12, there is a preferable embodiment as described later. For example, assuming that the width W3 is enough to allow the carrying arm to be inserted, the carrying device can be used when the object 10 that is a roll material wound around the axial center 12 having a hollow is placed in the packaging container 1, whereby the object 10 can be efficiently carried by the machine.

On the first auxiliary end wall portion 324*a* of the auxiliary frame 34, a reinforcing pad 39*a* having a carrying arm groove 391 having a width W3 that is substantially the same as that of the second auxiliary end wall portion 324*b* at the lower end portion may be provided. On the second auxiliary end wall portion 324*b* of the auxiliary frame 34, a reinforcing pad 39*b* having a carrying arm groove 392 having a width W3 that is substantially the same as that of the second auxiliary end wall portion 324*b* at the lower end portion may be provided. As with the auxiliary frame 34, the auxiliary frame 35 can also be provided with reinforcing pads 39*a*, 39*b*. This can lead to increased rigidity of the entire packaging container 1, ensuring the strength of the packaging container 1 when it is carried while suspending it. The reinforcing pads 39*a*, 39*b* may be omitted as needed.

When assembling the body frame 3, the first auxiliary end wall portion 325*a* and the second auxiliary end wall portion 324*b* are stacked on the body frame main body 30 such that the second bearing groove 315*a* and the carrying arm insertion groove 314*b* are stacked in this order on one of the first bearing grooves 310 of the body frame main body 30.

Figure 9:
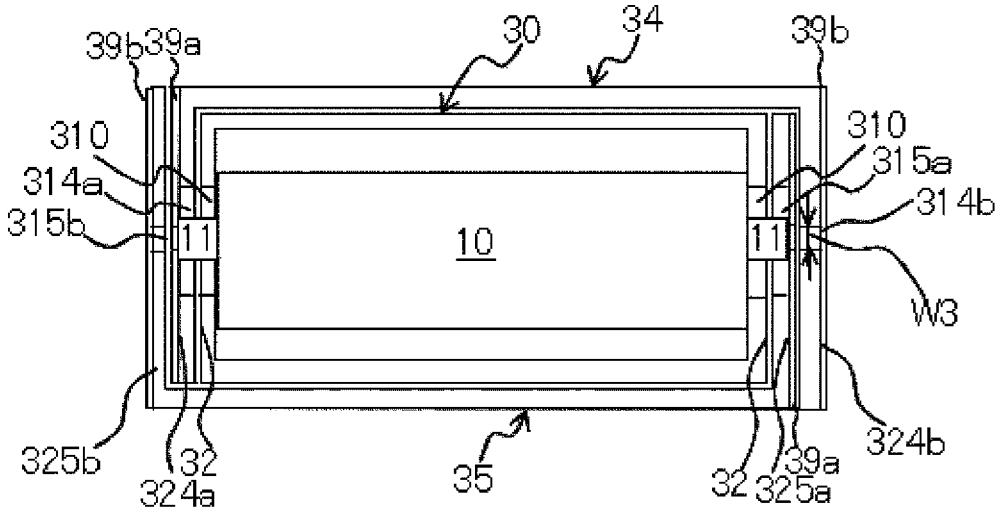
FIG. 9 is a top view showing a housing member being contained in a body frame.

FIG. 9 is a top view showing a method of stacking the body frame main body 30 and the auxiliary frames 34, 35 when the reinforcing pads 39*a*, 39*b* are attached to the auxiliary frames 34, 35. The auxiliary frames 34, 35 are stacked on the outer surface of the body frame main body 30 so as to face each other with the body frame main body 30 interposed therebetween.

As shown on the right side of FIG. 9, the first auxiliary end wall portion 325*a* of the auxiliary frame 35 provided with the second bearing groove 315*a* is stacked on the outer surface of one end wall portion 32 of the body frame main body 30. The reinforcing pad 39*a* is attached onto the outer surface of the first auxiliary end wall portion 325*a*, and on this outer surface, the second auxiliary end wall portion 324*b* of the auxiliary frame 34 provided with the carrying arm insertion groove 314*b* is stacked. The reinforcing pad 39*b* is attached to the outer surface of the second auxiliary end wall portion 324*b*.

As shown on the left side of FIG. 9, the first auxiliary end wall portion 324*a* of the auxiliary frame 34 provided with the second bearing groove 314*a* is stacked on the outer surface of the other end wall portion 32 of the body frame main body 30. The reinforcing pad 39*a* is attached on the outer surface of the first auxiliary end wall portion 324*a*, and on this outer surface, the second auxiliary end wall portion 325*b* of the auxiliary frame 35 provided with the carrying arm insertion groove 315*b* is stacked. The reinforcing pad 39*b* is attached to the outer surface of the second auxiliary end wall portion 325*b*.

By having such a stacked structure, the shaft support portion 11 on the right side of the FIG. 9 is supported by the end wall portion 32 and the first auxiliary end wall portion 325*a*, and the inner surface of the reinforcing pad 39*a* bonded and attached onto the outer surface of the first auxiliary end wall portion 325*a* substantially comes into contact with the end surface of the shaft support portion 11 of the object 10 and suppresses any movement of the shaft support portion 11 in a direction parallel to the axial direction. As a result, it is possible to provide a structure suitable for carrying in the suspended state while suppressing any damage and deformation of the packaging container 1.

The materials making up the body frame main body 30, the auxiliary frames 34, 35 and the reinforcing pads 38, 39*a*, 39*b* may be of the same type. However, when members having different strengths are used, it is preferable that the body frame main body 30 is made of a material having higher strength than that of the auxiliary frames 34, 35, more particularly, a material having higher compressive strength, because the first bearing groove 310 supports the shaft support portion 11 of the object 10 on the innermost side.

It is preferable that the auxiliary frames 34, 35 and the reinforcing pads 38, 39*a*, 39*b* are made of the same material as that of the body frame main body 30. On the other hand, the use of the material having the higher compressive strength may significantly increase the material cost. Therefore, depending on the strength required for the packaging container 1, one may appropriately select whether or not the materials of the auxiliary frames 34, 35 and the reinforcing pads 38, 39*a*, 39*b* are the same as those of the body frame main body 30.

The bearing groove 31 of the body frame 3 that supports the shaft support portions 11 of the object 10 is affected by the weight of the object 10 and external force during carrying, and tends to generate deformation or damage such as crushing. Therefore, it is preferable that the bearing groove 31 of the body frame 3 is arranged in the vertical direction of the leg portion 21.

When the body frame 3 has a three-layer structure of the body frame main body 30 and the auxiliary frames 34, 35, among the first bearing grooves 310 and the second bearing grooves 314*a*, 315*a* forming the bearing groove 31, the first bearing grooves 310 of the body frame main body 30 that support the shaft support portions 11 of the object 10 on the innermost side may be affected by the weight of the object 10 and the external force during carrying. Therefore, the packaging container 1 is preferably configured such that at least the leg portions 21 of the pallet 2 are arranged on a vertical line (on the vertical direction) of innermost contact points of the first bearing grooves 310 of the body frame main body 30 with the shaft support portions 11 of the object 10.

Examples of such a configuration includes adjusting the positions of the innermost contact points of the shaft support portions 11 with the first bearing grooves 310 with respect to the leg portions 21 by adjusting the number of the body frame main body 30, the auxiliary frames 34, 35 and the reinforcing pads 38, 39*a*, 39*b*. This can allow the weight of the object 10 transmitted from the shaft support portions 11 supported by the bearing groove 31 of the body frame 3 to be supported by the leg portions 21, thereby preventing deformation and breakage of the packaging container 1 due to the weight of the container 1 even during long-term transportation.

Further, the auxiliary frames 34, 35 disposed so as to surround the body frame main body 30 can be arranged directly above the holding surface 26 for hooking and holding the lifting tool on both ends of the packaging container 1, thereby improving a load bearing property and support the weight of the object 10 without difficulty. Therefore, a stable carrying state can be achieved.

During storage, both the tubular body frame main body 30 and the auxiliary frames 34, 35 can be bent and folded, so that the storage area can be saved. At the time of use, the cylindrical body frame main body 30 and the auxiliary frames 34, 35 can be assembled and used, so that the packaging container 1 can be more efficiently stored without requiring a large storage space as in the conventional wooden container.

Figure 10:
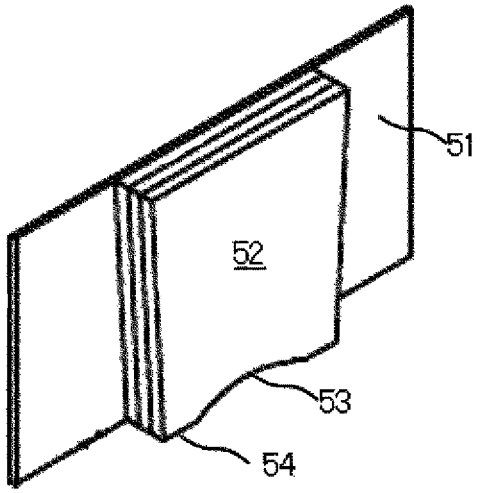
FIG. 10 is an external perspective view of an upper holding member.

As shown in FIG. 10, the upper holding member 5 includes: a base pad 51; and a guide pad 52 laminated near the center portion of the base pad 51. Below the guide pad 52 is a curved surface portion 53 which has substantially the same shape as the curved surface of the outer peripheral surface of each shaft support portion 11 of the object 10 and which restricts the movement of the object 10 in the up and down direction during carrying. Since the lower end portion 54 of the upper holding member 5 comes into contact with and stops on the locking portion 312 of the body frame main body 30, the position shift due to vibration during carrying hardly occurs, so that the upper holding member 5 can be stably stored for a long period of time in the housing portion 313.

Figure 11:
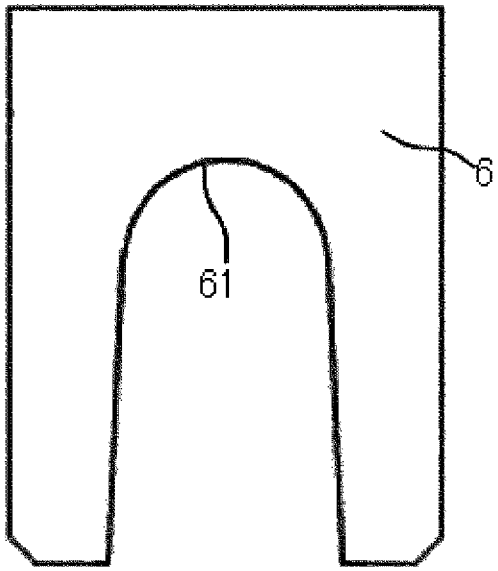
FIG. 11 is a front view of a spacer pad.

The guide pad 52 on the base pad 51 has a structure in which a plurality of corrugated cardboards are laminated via an adhesive. The laminated height of the guide pad 52 is preferably adjusted so as to match the thickness of the laminated portion laminated on the end wall portion 32 of the body frame main body 30. The arrangement of the upper holding member 5 in the bearing groove 31 of the body frame 3 can restrict the movement of the object 10 in the body frame 3 when it is carried. Further, the arrangement of the spacer pad 6 provided with a groove 61 as shown in FIG. 11 can fill the gap between the end face of the object 10 and the body frame main body 30, thereby suppressing the movement of the object 10 in the axial direction.

Figure 12:
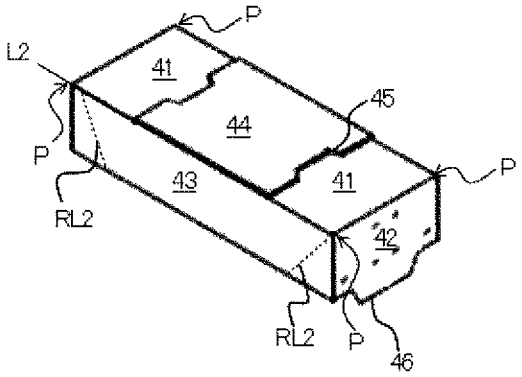
FIG. 12 is an external perspective view of a lid portion.

As shown in FIG. 12, the lid portion 4 includes: a top surface 41 that covers an upper part of the body frame 3; a pair of side wall portions 43 that extend downward from the top surface 41 and cover a part of the side wall portions 33 (auxiliary side wall portions 334, 335) of the body frame 3; a pair of end wall portions 42 that extend downward from the top surface 41 and cover a part of the end wall portions 32 (second auxiliary end wall portions 324*b*, 325*b*) of the body frame 3; and a top surface reinforcing portion 44 arranged on the top surface 41. During carrying, a binding member 71 is arranged on the top surface reinforcing portion 44 in order to bind the packaging container 1. By arranging the binding member 71, the top surface reinforcing portion 44 functions as a cushioning material, so that it is possible to suppress deformation and breakage of the lid portion 4 itself.

Figure 13:
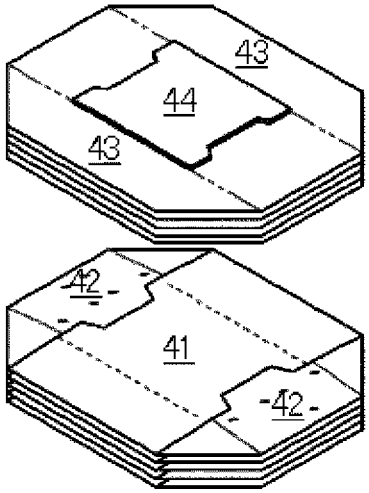
FIG. 13 is an external perspective view showing a folded state of a lid portion during storage.

At both ends of the top surface reinforcing portion 44 are notch portions 45 that are concave in the central direction. Further, each end wall portion 42 is provided with a protruding portion 46 that protrudes downward from the tip of the end wall portion 42. The notch portions 45 and the protruding portions 46 are formed so as to have substantially the same shape. Since the notch portions 45 and the protruding portions 46 have substantially the same shape, as shown in FIG. 13, when the lid portion 4 is bent and folded during storage of the lid portion 4, each notch portion 45 on the top surface reinforcing portion 44 of the lid portion 4 and each protruding portion 46 of the end wall portion 42 can be stacked while facing each other, so that the stacked height can be reduced when the lid portion 4 is stacked and stored in a folded state.

Each protruding portion 46 has a blindfold function. Since the body frame 3 has the first bearing grooves 310, the second bearing grooves 314*a*, 315*a* and the carrying arm insertion grooves 314*b*, 315*b*, the packaging of the body frame as it is will cause the first bearing grooves 310, the second bearing grooves 314*a*, 315*a* and the carrying arm insertion grooves 314*b*, 315*b* to be exposed to the outside. This will lead to unwanted adhesion of dust to the first bearing grooves 310, the second bearing grooves 314*a*, 315*a*, the carrying arm insertion grooves 314*b*, 315*b*, or the object 10 therein. By providing the protruding portions 46 on the end wall portions 42 of the lid portion 4, the first bearing grooves 310, the second bearing grooves 314*a*, 315*a* and the carrying arm insertion grooves 314*b*, 315*b* are covered, so that the dust from the outside can be prevented from entering.

The lid portion 4 is provided with four folding lines RL2 respectively extending in a diagonal direction from the four corner portions P of the top surface 41 on the side wall portions 43. Each folding line RL2 is inclined at an inclination of about 45 degrees from the point (corner P) where the top surface 41, the end wall portion 42, and the side wall portion 43 come into contact with one another, relative to the line where the top surface 41 and the side wall portion 43 come into contact with each other. By folding the folding lines RL2 in a mountain fold manner, the lid portion 4 can be stacked and stored in a state where the end wall portions 42 and the side wall portions 43 are folded, so that the storage space before assembling them as the packaging container 1 can be reduced. When the packaging container 1 is used, it is sufficient to raise the end wall portions 42 and the side wall portions 43, so that the lid portion 4 can be easily assembled.

An example of a packaging method using the packaging container 1 according to the embodiment of the present invention will now be described. First, the pallet 2, the body frame main body 30 forming the body frame 3, the auxiliary frames 34, 35, and the lid portion 4 are assembled so as to have a predetermined three-dimensional shape. The body frame 3 is then arranged on the pallet 2 by arranging the body frame main body 30 on the pallet 2, arranging the auxiliary frames 34, 35 arranged around the body frame main body 30, and assembling the body frame 3. The shaft support portions 11 of the object 10 are supported by a carrying arm or the like of a carrying device and carried in the body frame 3, and the object 10 is housed such that the shaft support portions 11 are supported by the bearing groove 31 of the body frame 3.

Figure 14:
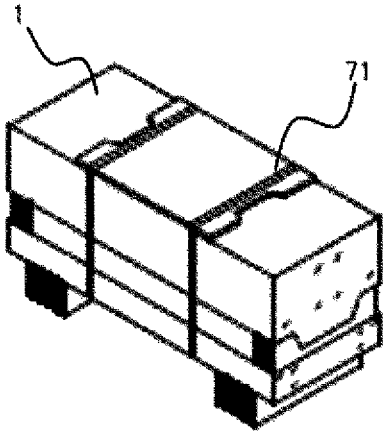
FIG. 14 is a schematic view showing a packaged state of a packaging container when it is carried.

Further, the upper holding member 5 is inserted from above the bearing groove 31, and the shaft support portions 11 supported by the bearing groove 31 are fixed from above by the upper holding member 5. The spacer pad 6 is arranged in the gap portion between the end portion of the object 10 and the body frame main body 30 to fill the gap between the end surface of the object 10 and the body frame main body 30. The lid portion 4 is then arranged on the body frame 3, and as shown in FIG. 14, the binding member 71 such as a strip-shaped band is arranged between the top surface of the lid portion 4 and the bottom surface of the pallet 2, and the periphery of the packaging container 1 is bound by the band-shaped binding member 71.

The lifting member for lifting and carrying is then brought into contact with the holding surface 26 provided between each end wall portion 23 and each leg portion 21, the holding surface 26 being located on the bottom surface 22 of the pallet 2 of the packaging container 1 containing the object 10, and the packaging container is lifted up, and a plurality of packaging containers 1 are stacked, and the reinforcing member is placed on the uppermost packaging container 1, and the stacked packaging container is bound by using the band-shaped binding member 71, and the bound packaging container is transported to an area to be transported.

As described above, according to the packaging container, the packaging method, and the method for carrying metal foil according to the embodiment of the invention, the leg portions 21 of the pallet 2 are located on an inner side of the end wall portions 23 of the pallet 2 at certain intervals S, whereby the packaging container 1 can be lifted up and carried while suspending the object 10 in the midair at an appropriate position. That is, it is possible to take any carrying manner other than the carrying manner while lifting up the packaging container 1 with the forklift jaws of the forklift as in the conventional art, which can lead to diversification of carrying means and improve a carrying efficiency.

Further, by forming the end wall portions 32 as a stacked structure with the body frame main body 30 and the auxiliary frames 34, 35, and arranging the leg portions 21 on the vertical line of the innermost contact point of the bearing groove 31 of the body frame 3 (the first bearing groove 310 of the body frame main body 30) that supports the gravity of the object 10 with the shaft support portions 11 of the object 10, the weight of the object 10 transmitted through the bearing groove 31 can be directly supported by the leg portions 21, so that it is possible to suppress deformation and damage such as crushing of the packaging container 1 when it is carried.

Further, by producing the packaging container 1 from corrugated cardboard, the packaging container 1 can be folded and housed during storage, which can save the space and decrease the weight as compared with the conventional wooden container. Therefore, an emission rate of $CO_2$ of the carrying means can be expected to be reduced, and more environmentally friendly packaging containers can be provided.

While the present invention has been described in accordance with the above embodiments, the descriptions and drawings that form a part of this disclosure should not be understood to limit this invention. That is, the present disclosure is not limited to the embodiments as described above, and the components can be modified and embodied without departing from the spirit of the present invention.

Although FIG. 1 shows an example in which the body frame 3 is composed of three members of the body frame main body 30 and the auxiliary frames 34, 35 which are overlapped so as to surround the body frame main body 30, the present embodiment is not limited to this example. For example, the auxiliary frames 34, 35 do not necessarily have to include the auxiliary side wall portions 334, 335. For example, auxiliary frames provided with auxiliary end wall portions having the same shape as those of the reinforcing pads 38 may be stacked on the end wall portions 32 of the body frame main body 30 so as to at least face the end wall portions 32 of the body frame main body 30. Although FIG. 1 shows an example in which the auxiliary frames 34, 35 are arranged on the outside of the body frame main body 30, it is also possible to arrange the auxiliary frames 34, 35 on the inside of the body frame main body 30.

DESCRIPTION OF REFERENCE NUMERALS

1 . . . packaging container
2 . . . pallet
3 . . . body frame
4 . . . lid portion
5 . . . upper holding member
6 . . . spacer pad
10 . . . object to be contained
11 . . . shaft support portion
21 . . . leg portion
30 . . . body frame main body
31 . . . bearing groove
34, 35 . . . auxiliary frame
310 . . . first bearing groove
314*a*, 315*a* . . . second bearing groove
314*b*, 315*b*, 391, 392 . . . carrying arm insertion groove
324*a*, 325*a* . . . first auxiliary end wall portion
324*b*, 325*b* . . . second auxiliary end wall portion
334, 335 . . . auxiliary side wall portion

The invention claimed is:

1. A packaging container made of corrugated cardboard comprising:

a pallet comprising leg portions;

a body frame arranged on the pallet and comprising bearing grooves provided at end wall portions opposing to each other; and a lid portion provided on the body frame, the lid portion comprising: a top surface reinforcing portion having notch portions at both ends, respectively; and protruding portions protruding on the end wall portions of the body frame so as to cover the bearing grooves of the body frame, the protruding portions having substantially the same shape as the notch portions, wherein the leg portions located inward on the pallet from end wall portions of the pallet.

2. The packaging container according to claim 1, wherein the bearing grooves are arranged on a vertical direction of the leg portions.

3. The packaging container according to claim 1, further comprising:

an upper holding member arranged in one of the bearing grooves and configured to hold down one of shaft support portions protruding from both ends of an object to be contained.

4. The packaging container according to claim 3, wherein each of the bearing grooves comprise a first bearing groove which can house one of the shaft support portions at a lower end portion, and house the upper holding member at an upper end portion, and wherein the first bearing groove comprises a locking portion which supports a lower end portion of the upper holding member.

5. The packaging container according to claim 1, wherein the body frame comprises:

a body frame main body comprising a first bearing groove provided at each of end wall portions opposing to each other; the first bearing groove being configured to house one of shaft support portions protruding from both ends of an object to be contained at a lower portion, and the first bearing groove can house an upper holding member which holds down one of the shaft support portions; and at least one auxiliary frame stacked on the body frame main body.

6. The packaging container according to claim 5, wherein the auxiliary frame comprises:

a first auxiliary end wall portion comprising a second bearing groove having substantially the same shape as that of the first bearing groove; and a second auxiliary end wall portion comprising a carrying arm insertion groove, in which a width in an arc horizontal direction at a lower end portion is narrower than a width in the arc horizontal direction at a lower end portion of the first bearing groove.

7. The packaging container according to claim 6, wherein the first auxiliary end wall portion is stacked on the body frame main body and the second auxiliary end wall portion is stacked on the body frame main body via the first auxiliary end wall portion such that the second bearing groove is located adjacent to the first bearing groove of the body frame main body and the carrying arm insertion groove is located adjacent to the second bearing groove.

8. The packaging container according to claim 1, wherein the pallet comprises a bottom surface reinforcing portion.

9. The packaging container according to claim 1, wherein each of the leg portions comprises a leg portion reinforcing portion.

10. The packaging container according to claim 1, wherein side wall portions of the lid portion comprise folding lines each extending in a diagonal direction from each of corner portions of the top surface.

11. The packaging container according claim 1, wherein the side wall portions of the pallet comprise folding lines each extending in a diagonal direction from each of corner portions of the bottom surface of the pallet.

12. The packaging container according to claim 1, wherein the packaging container contains a copper foil or a copper alloy foil.

13. A packaging method, the method comprising:

housing an object to be contained in the packaging container according to claim 1; and binding a top surface of the lid portion of the packaging container containing the object and a bottom surface of the pallet together, using a binding member.

14. A packaging method, the method comprising housing in the packaging container according to claim 1, a roll material in which a material is wound around a shaft center having a hollow structure.

15. A method for carrying metal foil, the method comprising:

housing in the packaging container according to claim 1, an object to be contained, the object being formed by winding a material comprised of metallic foil around its shaft center;

binding a top surface of the lid portion of the packaging container containing the object and a bottom surface of the pallet together, using a binding member;

bringing a lifting member for lifting and carrying into contact with a holding surface provided on a bottom surface between each of end wall portions and each of leg portions of the pallet of the packaging container containing the object; and carrying the packaging container while lifting up the packaging container.

16. A carrying method, the method comprising housing in the packaging container according to claim 1 a roll material in which a material is wound around a shaft center having a hollow structure, and carrying the roll material.

17. A packaging container made of corrugated cardboard comprising:

a pallet comprising leg portions;

a body frame arranged on the pallet and comprising bearing grooves provided at end wall portions opposing to each other; and a lid portion provided on the body frame, wherein the body frame comprises:

a body frame main body; and at least one auxiliary frame stacked on the body frame main body, wherein the body frame main body comprises a first bearing groove provided at each of the end wall portions, the first bearing groove being able to house one of shaft support portions protruding from both ends of an object to be contained, and wherein the auxiliary frame comprises a first auxiliary end wall portion comprising a second bearing groove having substantially the same shape as that of the first bearing groove; and a second auxiliary end wall portion comprising a carrying arm insertion groove, in which a width in an arc horizontal direction at a lower end portion is narrower than a width in the arc horizontal direction at a lower end portion of the first bearing groove.

18. The packaging container according to claim 17, wherein the first auxiliary end wall portion and the second auxiliary end wall portion are stacked on the body frame main body such that the second bearing groove and the carrying arm insertion groove are stacked in this order on the first bearing groove of the body frame main body.

* * * * *